US005882232A

United States Patent [19]

Sano

[11] Patent Number: 5,882,232

[45] Date of Patent: Mar. 16, 1999

[54] ELECTRICAL CONNECTOR

[75] Inventor: Takahiro Sano, Shizuoka, Japan

[73] Assignee: Yazaki Corporation, Tokyo, Japan

[21] Appl. No.: 916,327

[22] Filed: Aug. 22, 1997

[30] Foreign Application Priority Data

Aug. 26, 1996 [JP] Japan ..... 8-223736

[51] Int. Cl.[6] ..... H01R 13/514

[52] U.S. Cl. ..... 439/752

[58] Field of Search ..... 439/752, 595

[56] References Cited

U.S. PATENT DOCUMENTS

Re. 34,539 2/1994 Aoyama ..... 439/752

FOREIGN PATENT DOCUMENTS 8-124623 5/1996 Japan .

*Primary Examiner*—Neil Abrams
*Assistant Examiner*—Javaid Nasri
*Attorney, Agent, or Firm*—Morgan, Lewis & Bockius LLP

[57] ABSTRACT

An electrical connector includes a terminal-connected wire, a housing an a rear holder. The housing, which receives the terminal of the terminal-connected wire, has a terminal receiving portion, a rear holder receiving portion, and at least two projected piece portions provided within the rear holder receiving portion. The rear holder, which retains the terminal in the housing, has a peripheral wall with a shape corresponding to an inner peripheral surface of the rear holder receiving portion, insertion openings provided inside the peripheral wall for passing the wires from the terminal receiving portion, and notches formed in the peripheral wall for introducing the wires into the insertion openings. The projected piece portions contact an inner peripheral surface of the rear holder to retain the terminal.

8 Claims, 7 Drawing Sheets

ELECTRICAL CONNECTOR

This application claims the benefit of Application No. Hei. 8-223736, filed in Japan on Aug. 26, 1996, which is hereby incorporated by reference.

BACKGROUND OF THE INVENTION

1. Field of the Invention

This invention relates to an electrical connector in which terminals are received and retained in a housing, and more particularly, to an electrical connector having a rear holder.

2. Discussion of the Related Art

A conventional connector, having a rear holder, is disclosed, for example, in Japanese Unexamined Patent Application Publication No. 8-124623 filed by the Applicant of the present application. FIG. 5 is a perspective view of the conventional connector disclosed in Japanese Unexamined Patent Application Publication No. 8-124623, FIG. 6 is an exploded, perspective view of the connector of FIG. 5, and FIG. 7 is a cross-sectional view of the connector of FIG. 5.

The connector 100 is used to interconnect circuits provided inside and outside a transmission casing of an automatic transmission, and the connector is mounted on a side wall of the transmission casing. As shown in FIG. 5, the connector 100 comprises a housing 102 made of a resin, a plurality of terminal-connected wires 104, a rear holder 106 retaining terminals 105 received in the housing 102, and a sealing resin material 107 sealing the interior of the housing 102 to prevent leakage of oil and the like.

As shown in FIGS. 6 and 7, one end portion of the housing 102 forms a receiving portion 108 for receiving a mating connector (not shown), and electrical contact portions of the received terminals 105 project into this receiving portion 108. The other end portion of the housing 102 forms a terminal receiving portion 109 in which the terminal-connected wires 104 are inserted. A plurality of cavities 111 are formed in a partition wall 110 within the terminal receiving portion 109, and are arranged in two rows, i.e., upper and lower rows. The terminals 105 are received in the cavities 111, respectively. A filling chamber 112, communicating with the cavities 111, is provided in the terminal receiving chamber 109.

As shown in FIG. 6, the rear holder 106 includes retaining projections 113 and a positioning plate 114, and the retaining projections 113 are retainingly engaged respectively in retaining holes 115 formed through a peripheral wall of the terminal receiving portion 109, and the positioning plate 114 is retainingly engaged in a positioning groove 116 formed in the peripheral wall of the terminal receiving portion 109. The rear holder 106 has an insertion notch 117, extending from the upper row of cavities 111, through which the wires 104 pass.

In the connector 100, one end of each of the terminal-connected wires 104 is inserted into the housing 102 while the other end is inserted into another housing (not shown). Thereafter, the terminal-connected wires 104 can be passed through the insertion notch 117, and then the rear holder 106 can be attached to the housing 102. Specifically, the wires 104, extending outwardly from the housing 102, are passed through the insertion notch 117. The rear holder 106 is moved toward the housing 102 along the wires 104 to engage with the peripheral wall of the terminal receiving portion 109. Then, the rear holder may be attached to the housing 102.

However, in the conventional connector 100, the insertion notch 117 is formed in the rear holder 106. Therefore, side wall portions of the rear holder 106, forming the insertion notch 117, have reduced strength. Thus, the rear holder 106 is liable to deformation. As a result, when engaging the rear holder 106 with the housing 102, the retaining projections 113 on the rear holder 106 can not be brought into registry with the retaining holes 115, respectively, and the rear holder 106 can not be properly engaged with the housing 102, and in some cases it has been difficult to attach the rear holder 106 to the housing 102.

SUMMARY OF THE INVENTION

Accordingly, the present invention is directed to an electrical connector that substantially obviates one or more of the problems due to limitations and disadvantages of the related art.

An object of the invention is to provide a connector in which a rear holder can be attached to a housing after terminal-connected wires have been inserted.

Another object of the present invention is to provide a connector wherein deformation of the rear holder is corrected so that the rear holder can be positively and easily attached to the housing.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electrical connector comprises a terminal-connected wire having a terminal on an end thereof; a housing for receiving the terminal of the terminal-connected wire, the housing including a terminal receiving portion, a rear holder receiving portion, and at least two projected piece portions provided within the rear holder receiving portion; and a rear holder for retaining the terminal in the housing, the rear holder including a peripheral wall with a shape corresponding to an inner peripheral surface of the rear holder receiving portion, insertion openings provided inside the peripheral wall for passing the wires from the terminal receiving portion, and notches formed in the peripheral wall for introducing the wires into the insertion openings, wherein the projected piece portions contact an inner peripheral surface of the rear holder.

In another aspect, the connector comprises terminal-connected wires, a housing for receiving terminals of the terminal-connected wires, and a rear holder for retaining the terminals in the housing; wherein the housing includes at least a terminal receiving portion and a rear holder receiving portion, and at least two projected piece portions for contact with an inner peripheral surface of the rear holder are provided within the rear holder receiving portion; and wherein the rear holder includes a peripheral wall corresponding in shape to an inner peripheral surface of the rear holder receiving portion, and insertion openings for passing the wires, extending outwardly from the terminal receiving portion, therethrough are provided inside the peripheral wall, and notches for introducing the wires into the insertion openings are formed in the peripheral wall.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
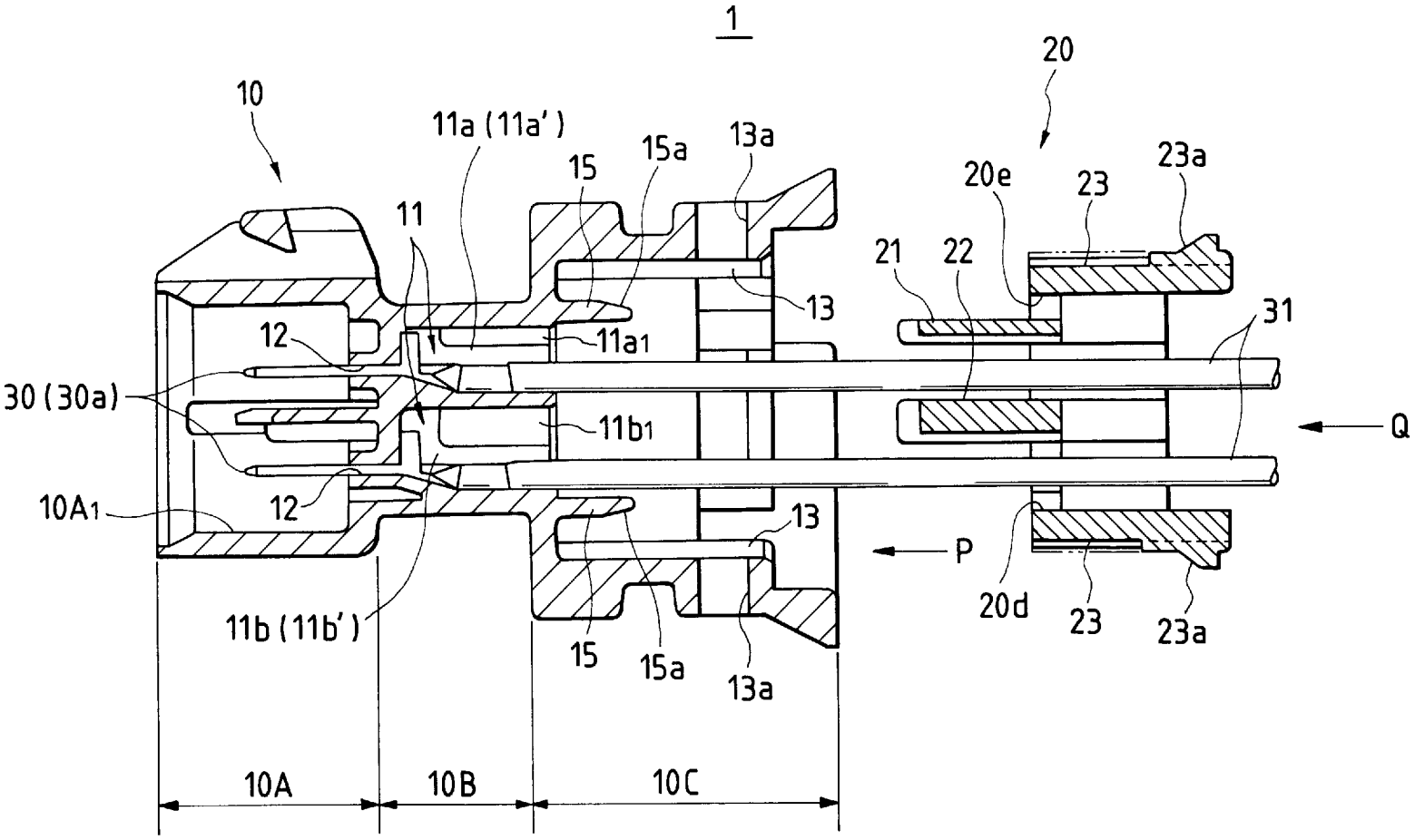
FIG. 1 is a vertical cross-sectional view showing a housing and a rear holder in a preferred embodiment of a connector of the invention.
Figure 2A:
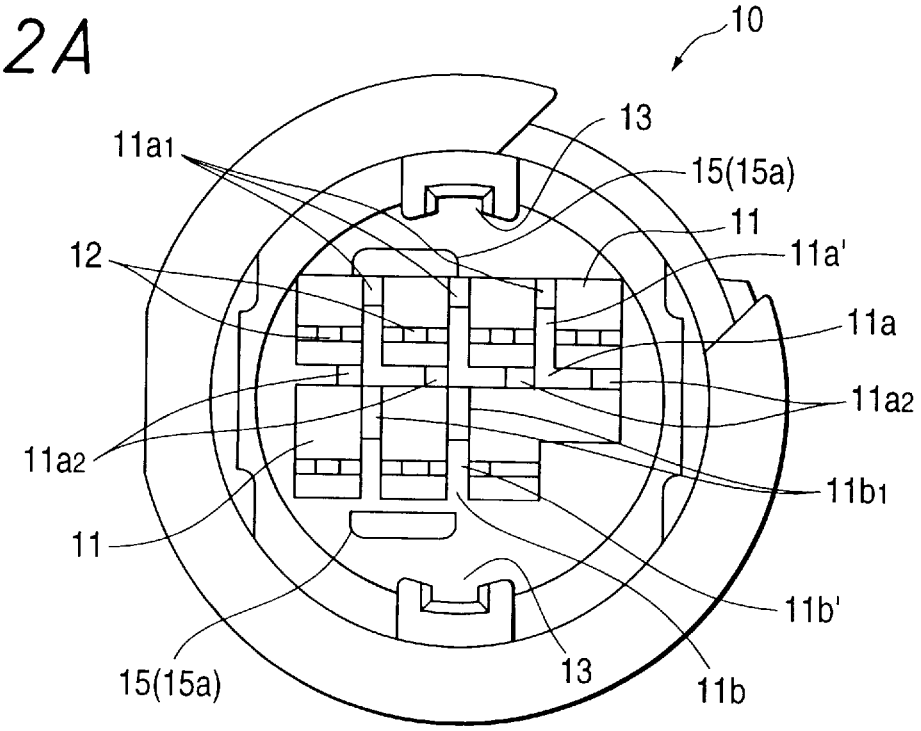
FIG. 2A is a view as seen in a direction P of FIG. 1.
Figure 2B:
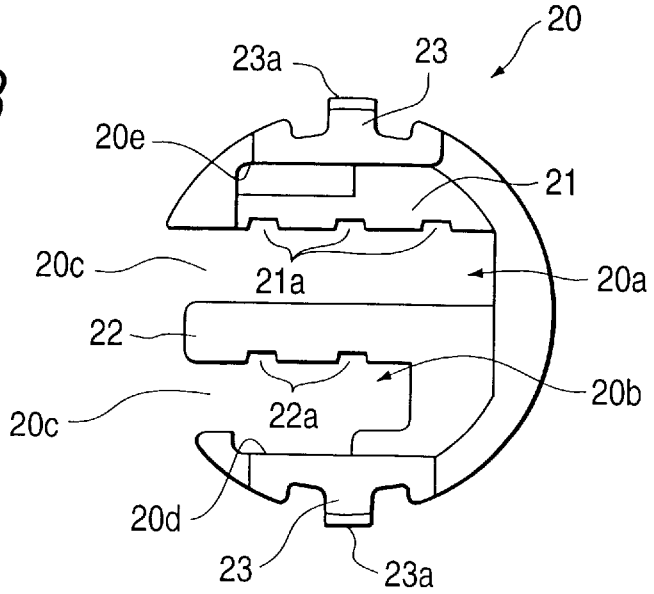
FIG. 2B is a view as seen in a direction Q of FIG. 1.

FIG. 1 is a vertical cross-sectional view showing a housing and a rear holder in the embodiment of the connector of the invention, FIG. 2A is a view as seen in a direction P of FIG. 1, and FIG. 2B is a view as seen in a direction Q of FIG. 1. In FIG. 1, the housing 10 of the connector 1 includes a receiving portion 1OA for receiving a mating connector (not shown), a terminal receiving portion 10B, and a rear holder receiving portion 10C.

In FIGS. 2A and 2B, a plurality of cavities 11 are provided within the terminal receiving portion 10B, and are arranged in two rows, i.e., upper and lower rows. The cavities 11 are separated from one another by first wall portions 11*a* and second wall portions 11*b*, which are partially notched, such that the cavities communicate with one another. More specifically, the first wall portion 11*a* has notches $\mathbf{11}a_1$ and $\mathbf{11}a_2$, and the second wall portion 11*b* has a notch $\mathbf{11}b_1$.

As shown in FIGS. 1, 2A, and 2B, each cavity 11 has a terminal insertion hole 12 communicating the cavity 11 with the receiving portion A, and an electrical contact portion 30*a* of a terminal 30 is press-fitted into the terminal insertion hole 12. Therefore, the plurality of terminals 30 are received in the cavities 11, respectively. The electrical contact portion 30*a* of the terminal 30, press-fitted in the terminal insertion hole 12, projects into a hood $\mathbf{10}A_1$ of the receiving portion 10A.

Two projected piece portions 15 are formed generally perpendicularly on a wall portion provided at the boundary between the rear holder receiving portion 10C and the terminal receiving portion 10B. A distal end portion of each projected piece portion 15 has a slanting outer surface 15*a* slanting toward the respective distal end.

Two guide grooves 13 are formed in an inner surface of a peripheral wall of the rear holder receiving portion 10C, and extend toward the cavities 11. Two engagement holes 13*a* are formed through the peripheral wall of the rear holder receiving portion 10C, and communicate with the guide grooves 13, respectively.

In FIGS. 1 and 2B, the rear holder 20 of the connector 1 for an automatic transmission includes a peripheral wall having a shape corresponding to the inner peripheral surface of the rear holder receiving portion 10C of the housing 10, and insertion openings 20*a* and 20*b* inside the peripheral wall of the rear holder 20 for passing wires 31 extending outwardly from the terminal receiving portion 10B, and notches 20*c* for introducing the wires 31 into the insertion openings 20*a* and 20*b* are formed in the peripheral wall of the rear holder.

A guide notch (guide portion) 20*d* and a guide hole (guide portion) 20*e* are formed in the inner peripheral surface of the rear holder 20. The guide notch 20*d* and the guide hole 20*e* are generally equal in width to the projected piece portions 15 of the housing 10, and when engaging the rear holder 20 in the housing 10, the guide notch 20*d* and the guide hole 20*e* cooperate respectively with the projected piece portions 15 to position and guide the rear holder 20.

The rear holder 20 has first and second projecting wall piece portions 21 and 22 which cooperate with the notches $\mathbf{11}a_1$, $\mathbf{11}a_2$ and $\mathbf{11}b_1$, formed in the first and second wall portions 11*a* and 11*b* of the cavities 11, to separate the cavities 11 from one another when the rear holder 20 is engaged in the housing 10.

When the rear holder 20 is engaged in the housing 20, the first wall piece portion 21 is inserted into the notches $\mathbf{11}a_1$ in the first wall portions 11*a* to close these notches $\mathbf{11}a_1$, and also locks the terminals 30, received respectively in the cavities 11 formed respectively by the first wall portions 11*a*, at its distal end. In order to achieve the close contact of the first wall piece portion 21 with the first wall portions 11*a*, three grooves 21*a* for respectively fitting on upper ends of vertical walls 11*a*' of the first wall portions 11*a* are formed in the first wall piece portion 21.

When the rear holder 20 is engaged in the housing 10, the second wall piece portion 22 is inserted into the notches $\mathbf{11}b_1$, formed respectively in the second wall portions 11*b*, to close these notches $\mathbf{11}b_1$ and the notches $\mathbf{11}a_2$ formed respectively in the first wall portions 11*a*. At the same time, the second wall piece portion 22 locks the terminals 30, received respectively in the cavities 11 formed respectively by the second wall portions 11*b*, at its distal end. In order to achieve the close contact of the second wall piece portion 22 with the second wall portions 11*b*, two grooves 22*a* for respectively fitting on upper ends of vertical walls 11*b*' of the second wall portions 11*b* are formed in the second wall piece portion 22.

Two guide rails 23, corresponding respectively to the guide grooves 13 formed in the housing 10, are formed on the outer surface of the rear holder 20, and engagement pawls 23*a* for engaging in the respective engagement holes 13*a* are formed respectively on the guide rails 23 in a generally continuous relation thereto.

Figure 3A:
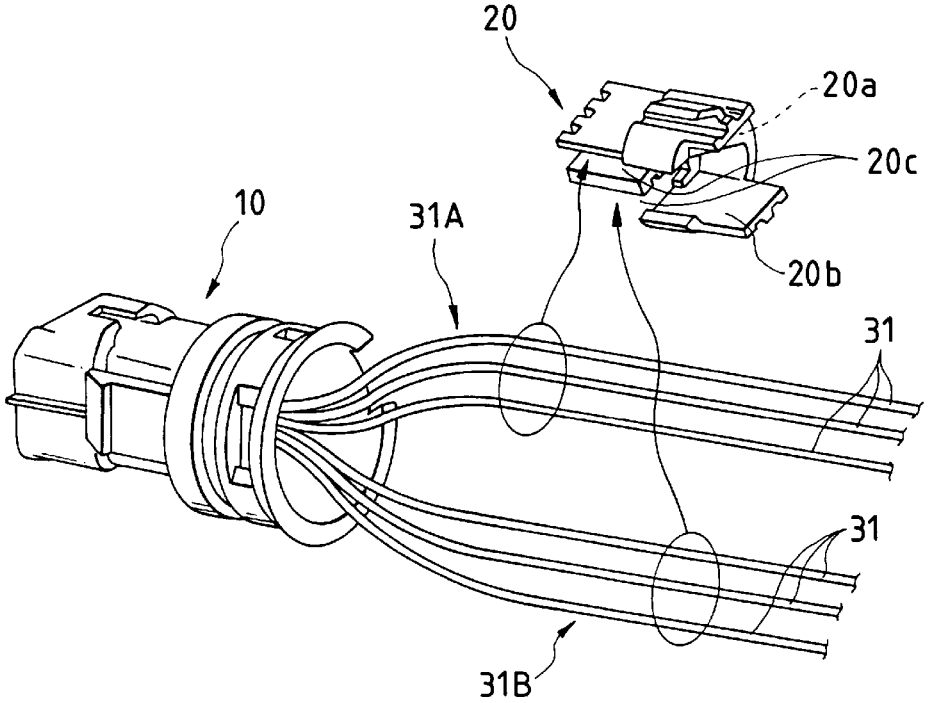
FIGS. 3A and 3B are views showing a procedure of attaching of the rear holder and passing wires through the rear holder.
Figure 3B:
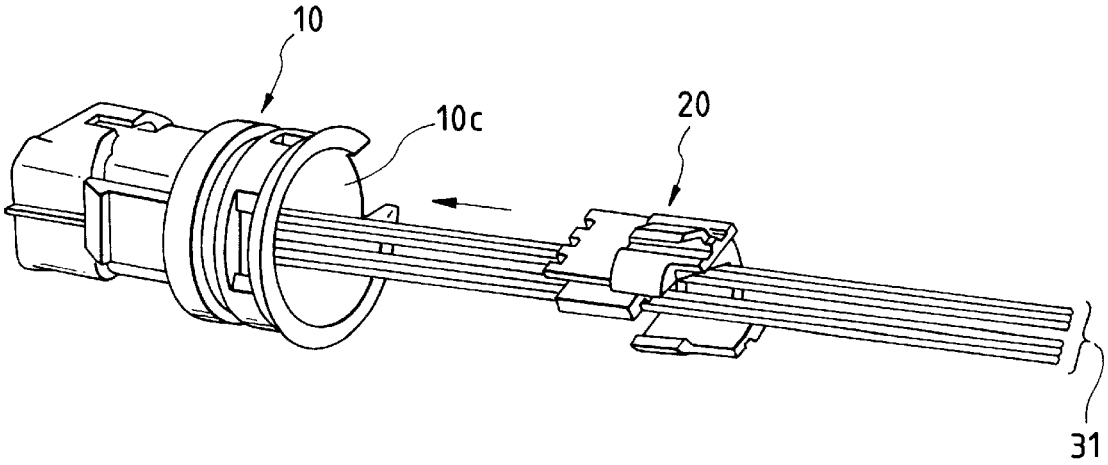
Figure 4A:
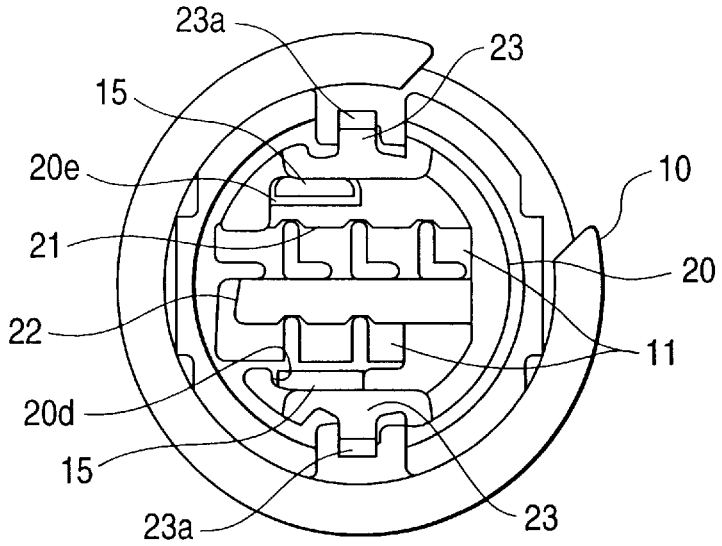
FIGS. 4A, 4B and 4C are views showing a procedure of attaching of the rear holder illustrating the rear holder deformation-correcting operation when the rear holder is attached to the housing.
Figure 4B:
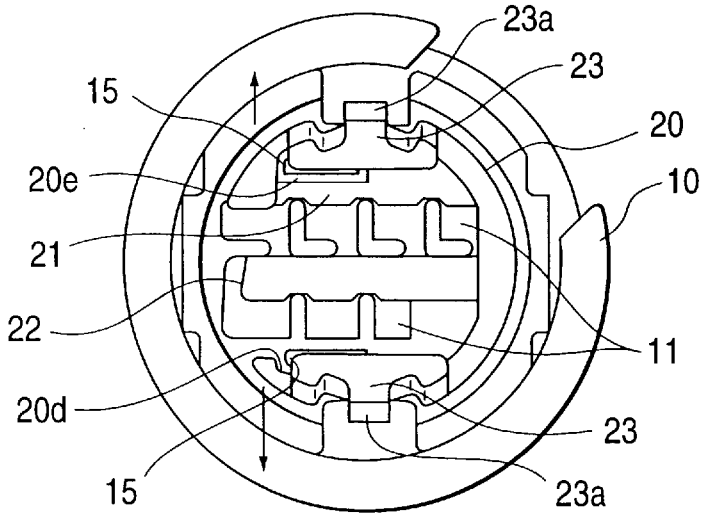
Figure 4C:
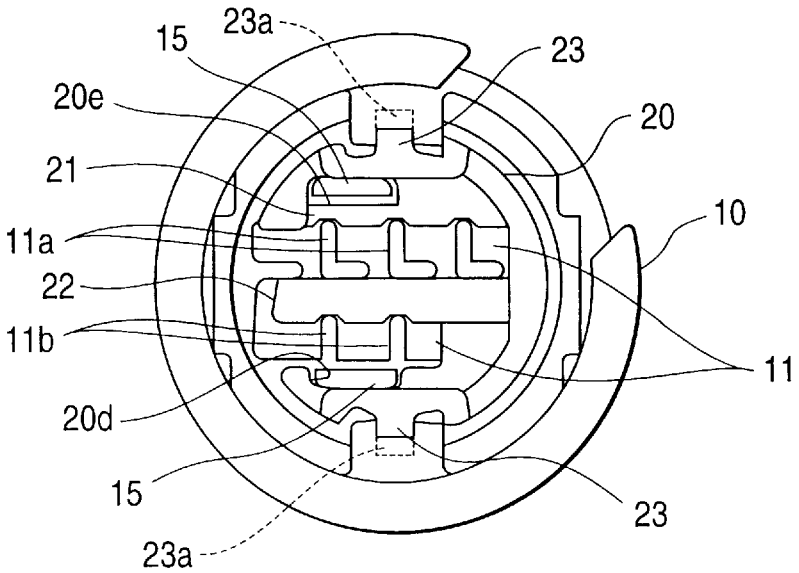
Figure 5:
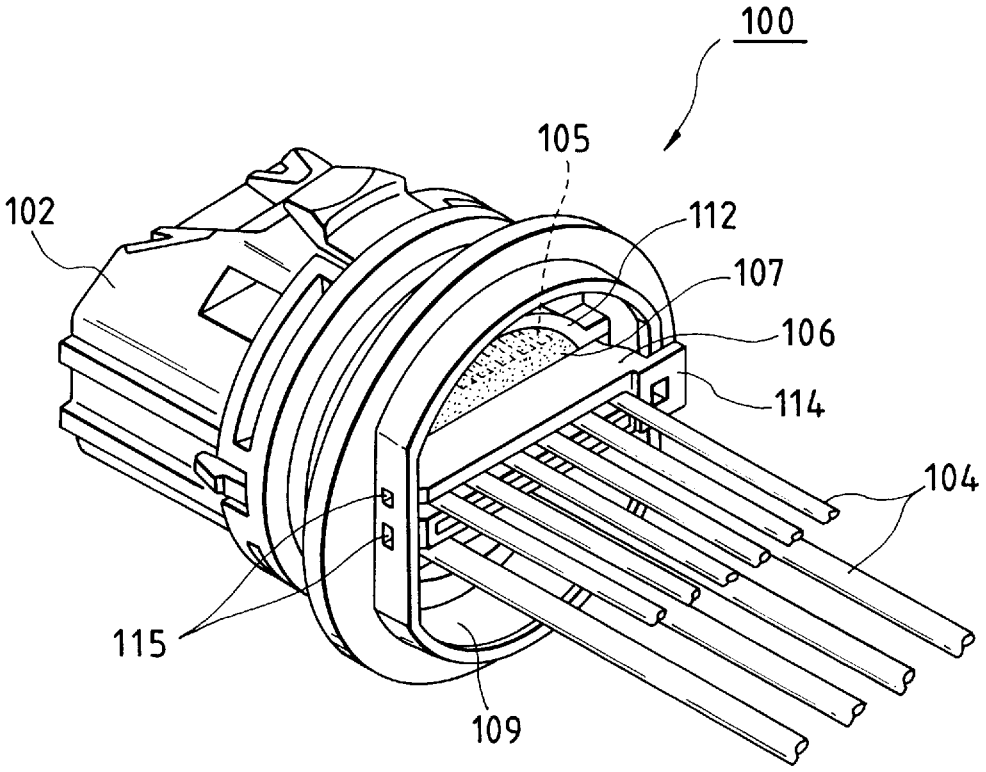
FIG. 5 PRIOR ART
FIG. 5 is a perspective view of a conventional connector.
Figure 6:
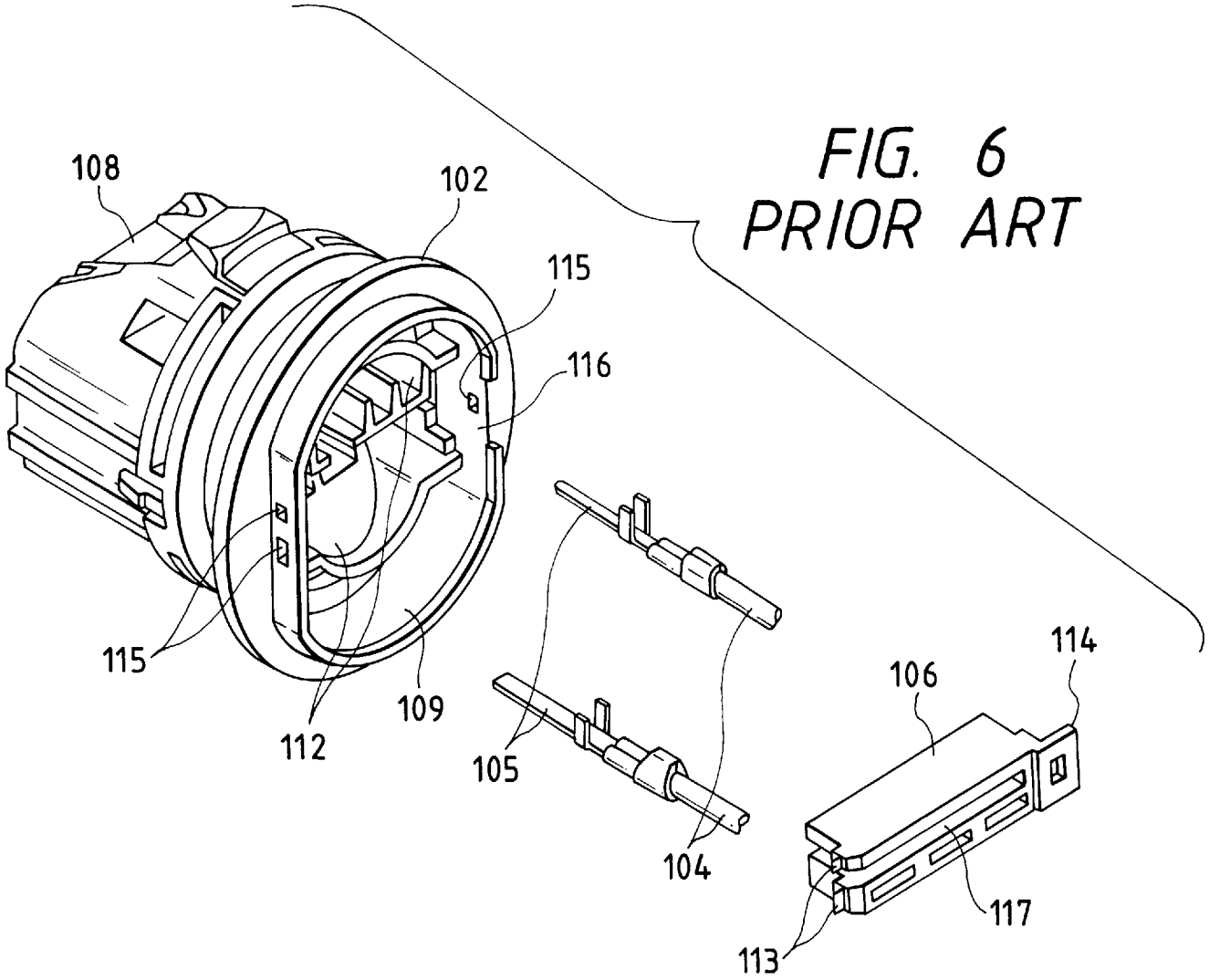
FIG. 6 PRIOR ART
FIG. 6 is an exploded, perspective view of the connector of FIG. 5.
Figure 7:
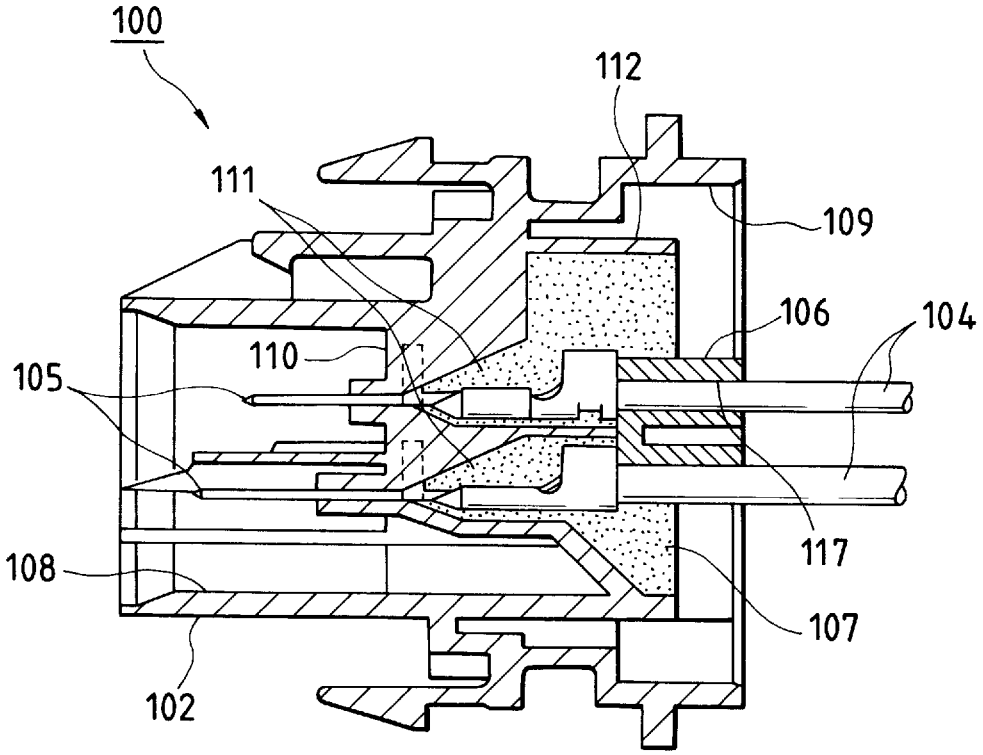
FIG. 7 PRIOR ART
FIG. 7 is a cross-sectional view of the connector of FIG. 5.

A procedure for attaching the rear holder 20 to the connector 1 will now be described with reference to FIGS. 3A, 3B, 4A, 4B and 4C. FIGS. 3A and 3B and FIGS. 4A, 4B and 4C show sequential steps of attaching the rear holder 20. FIGS. 3A and 3B are perspective views showing the steps of passing the wire 31 through the rear holder 20, and FIGS. 4A, 4B and 4C are plan views showing a rear holder deformation-correcting operation when the rear holder 20 is attached to the housing 10.

In the assembly of the connector 1, the terminals 30 are each respectively connected to an end of a wire 31 and inserted into a respective cavity 11 in the housing 10. The terminals 30 are then press-fitted respectively into the terminal insertion holes 12, so that the terminals 30 are received in the cavities 11, as shown in FIG. 1. The terminal insertion holes 12 are closed respectively by the terminals 30 press-fitted thereinto.

At this time, terminals (not shown), connected respectively to the other ends of the wires 31, may be inserted respectively into cavities in another connector. Then, the rear holder is attached to the housing 10 into which the terminal-connected wires 31 have already been inserted.

More specifically, as shown in FIG. 3A, a group of wires 31A, extending outwardly respectively from the upper row of cavities 11 (see FIG. 1), are passed through the insertion opening 20*a* in the rear holder 20 through the notch 20*c*, and also a group of wires 31B, extending outwardly respectively from the lower row of cavities 11 (see FIG. 1), are passed through the insertion opening 20*b* in the rear holder 20 through the notch 20*a*. Thus, the group of wires 31 are passed through the rear holder 20.

Then, as shown in FIG. 3B, the rear holder 20 is moved toward the housing 10 along the group of wires 31, and the guide rails 23 and 23 are moved respectively along the guide grooves 13 and 13 (see FIG. 1), and the rear holder 20 is inserted into the rear holder receiving portion 10C of the housing 10.

As a result, the projected piece portions 15 of the housing 10 are inserted respectively into the guide notch 20*d* and the guide hole 20*e* in the rear holder 20, as shown in FIG. 4(*a*), and as the insertion of the rear holder 20 proceeds, the peripheral wall of the rear holder 20 is gradually spread outwardly as shown in FIG. 4B.

Then, when the rear holder 20 is completely inserted into the rear holder receiving portion 10C as shown in FIG. 4C, the inward deformation of the rear holder 20 is corrected. As a result, the first wall piece portion 21 of the rear holder 20 is inserted into the notches $\mathbf{11}a_1$, in the first wall portions 11*a* of the cavities 11 while the second wall piece portion 22 is inserted into the notches $\mathbf{11}b_1$, in the second wall portions 11*b*, so that the notches $\mathbf{11}a_1$, $\mathbf{11}a_2$ and $\mathbf{11}b_1$, (see FIG. 2) are closed.

At the same time, the engagement pawls 23*a* of the rear holder 20 are engaged respectively in the engagement holes 13*a* in the housing 10, so that the rear holder 20 is retained in the rear holder receiving portion 10C of the housing 10. The distal ends of the first and second wall piece portions 21 and 22 are engaged with the terminals 30 in the respective cavities 11, so that the terminals 30 are retained in the respective cavities 11.

By filling a sealing resin material (not shown) in the housing 10, the connector 1 can be used as a connector for an automatic transmission. In this case, since the notches $\mathbf{11}a_1$, $\mathbf{11}a_2$ and $\mathbf{11}b_1$, are formed in the first and second wall portions 11*a* and 11*b* to communicate the cavities 11 with one another, the sealing resin material can easily flow into the cavities 11. Therefore, the sealing resin material can be positively and easily filled in the cavities 11, thereby enhancing the seal.

In the connector 1 of this embodiment, the group of wires 31, extending outwardly from the housing 10, can be passed through the insertion openings 20*a* and 20*b* through the notches 20*c* in the rear holder 20. Therefore, the rear holder 20 can be attached to the housing 10 later. Because of the provision of the notches 20*c*, the rear holder 20 is liable to be deformed inwardly, but when engaging the rear holder 20 in the housing 10, the projected plate portions 15 of the housing 10 contact the inner peripheral surface of the rear holder 20 to spread the peripheral wall of the rear holder 20 outwardly, thereby correcting the deformation of the rear holder. Therefore, the rear holder 20 can be positively and easily attached to the housing 20.

The distal end portion of each of the projected piece portions 15 has the slanting outer surface 15*a* slanting toward its distal end, and therefore the inner peripheral surface of the rear holder 20 is guided by the slanting surfaces 15*a*, and the deformation of the rear holder 20 can be smoothly corrected. Further, the rear holder 20 can be easily inserted into the housing 10.

The guide notch 20*d* and the guide hole 20*e*, which are to be guided respectively by the projected piece portions 15, are formed in the inner peripheral surface of the rear holder 20, and therefore the positioning of the rear holder 20 when inserting the rear holder 20 into the housing 20 can be effected easily.

As described above, in the connector of the invention, the rear holder can be attached to the housing after the terminal-connected wires have been inserted. Further, the deformation problem of the rear holder is corrected so that the rear holder can be positively and easily attached to the housing.

It will be apparent to those skilled in the art that various modifications and variations can be made in the electrical connector of the present invention without departing from the spirit or scope of the invention. Thus, it is intended that the present invention cover the modifications and variations of this invention provided they come within the scope of the appended claims and their equivalents.

What is claimed is:

1. An electrical connector, comprising:

a terminal-connected wire having a terminal on an end thereof;

a housing for receiving the terminal of the terminal-connected wire, the housing including a terminal receiving portion, a rear holder receiving portion, and at least two projected piece portions, the projected piece portions provided within the rear holder receiving portion; and a rear holder for retaining the terminal in the housing, the rear holder including a peripheral wall with a shape corresponding to an inner peripheral surface of the rear holder receiving portion, insertion openings provided inside the peripheral wall for passing the wires from the terminal receiving portion, and notches formed in the peripheral wall for introducing the wires into the insertion openings, wherein the projected piece portions contact an inner peripheral surface of the peripheral wall of the rear holder.

2. The electrical connector according to claim 1, in which a distal end portion of each of the projected piece portions has a slanting outer surface slanting toward its distal end.

3. The electrical connector according to claim 2, in which guide portions for being guided respectively by the projected piece portions are formed at the inner peripheral surface of the rear holder.

4. The electrical connector according to claim 1, in which guide portions for being guided respectively by the projected piece portions are formed at the inner peripheral surface of the rear holder.

5. The electrical connector according to claim 1, wherein portions of the peripheral wall of the rear holder are received between the projected piece portions and the inner peripheral surface of the rear holder receiving portion.

6. The electrical connector according to claim 3, wherein portions of the peripheral wall of the rear holder are received between the projected piece portions and the inner peripheral surface of the rear holder receiving portion.

7. The electrical connector according to claim 1, wherein the electrical connector is connected to an automatic transmission.

8. The electrical connector according to claim 1, wherein the electrical connector provides electrical signals to an automatic transmission.

* * * * *